US010364513B2

(12) United States Patent
Apell et al.

(10) Patent No.: US 10,364,513 B2
(45) Date of Patent: Jul. 30, 2019

(54) RADIATION PROTECTIVE MATERIAL

(71) Applicant: Ten Medical Design AB, Onsala (SE)

(72) Inventors: Petra Apell, Onsala (SE); Fredrik Gellerstedt, Onsala (SE)

(73) Assignee: Ten Medical Design AB, Onsala (SE)

( * ) Notice: Subject to any disclaimer, the term of this patent is extended or adjusted under 35 U.S.C. 154(b) by 0 days.

(21) Appl. No.: 14/782,368

(22) PCT Filed: Apr. 4, 2014

(86) PCT No.: PCT/SE2014/050412

§ 371 (c)(1),
(2) Date: Oct. 5, 2015

(87) PCT Pub. No.: WO2014/163574

PCT Pub. Date: Oct. 9, 2014

(65) Prior Publication Data

US 2016/0060791 A1 Mar. 3, 2016

(30) Foreign Application Priority Data

Apr. 5, 2013 (SE) ..... 1350419

(51) Int. Cl.
*D01F 1/10* (2006.01)
*G21F 3/02* (2006.01)
(Continued)

(52) U.S. Cl.
CPC ..... *D01F 1/106* (2013.01); *D03D 1/0035* (2013.01); *D03D 1/0058* (2013.01); *D03D 15/00* (2013.01); *D03D 15/0027* (2013.01); *G21F 1/106* (2013.01); *G21F 3/02* (2013.01); *G21F 3/025* (2013.01); *D10B 2501/04* (2013.01); *D10B 2509/00* (2013.01)

(58) Field of Classification Search
None
See application file for complete search history.

(56) References Cited

U.S. PATENT DOCUMENTS 3,911,922 A * 10/1975 Kliger ..... A61F 13/44 428/159
3,996,620 A * 12/1976 Maine ..... A41D 13/04 2/455

(Continued)

FOREIGN PATENT DOCUMENTS

CH 668555 A5 1/1989
CN 202007296 U 10/2011

(Continued)

OTHER PUBLICATIONS

SU 440462 A published 1975. DERWENT Translation of abstract copywrite 2016.*

(Continued)

*Primary Examiner* — Michael J Logie
(74) *Attorney, Agent, or Firm* — Downs Rachlin Martin PLLC

(57) ABSTRACT

The invention concerns a radiation protective material, which comprises a fibrous material with composite filaments including a radiopaque substance. The filaments are structured in a regular pattern to form the radiation shielding material.

39 Claims, 2 Drawing Sheets

(51) Int. Cl.

| | |
|---|---|
| ***G21F 3/025*** | (2006.01) |
| ***D03D 15/00*** | (2006.01) |
| ***D03D 1/00*** | (2006.01) |
| ***G21F 1/10*** | (2006.01) |

(56) References Cited

U.S. PATENT DOCUMENTS 4,146,417 A * 3/1979 Drelich ..... D04H 1/64 156/181
4,185,626 A 1/1980 Jones et al.
4,517,793 A 5/1985 Carus et al.
5,024,232 A * 6/1991 Smid ..... A61K 6/083 523/117
5,053,275 A 10/1991 Kagechi et al.
5,103,504 A * 4/1992 Dordevic ..... A41D 13/008 139/425 R
5,256,334 A * 10/1993 Smid ..... A61K 6/083 252/478
5,981,409 A * 11/1999 Takagi ..... D03D 15/00 139/420 A
6,077,880 A * 6/2000 Castillo ..... A61L 29/041 523/105
6,281,515 B1 8/2001 Demeo et al.
6,459,091 B1 10/2002 DeMeo et al.
6,828,578 B2 12/2004 DeMeo et al.
6,841,791 B2 1/2005 DeMeo et al.
7,476,889 B2 1/2009 DeMeo et al.
9,475,263 B1 * 10/2016 Rangan ..... B32B 27/00
2002/0148980 A1 * 10/2002 Cadwalader ..... G21F 1/103 250/515.1
2002/0193032 A1 * 12/2002 Newkirk ..... A61F 13/49453 442/401
2003/0010939 A1 * 1/2003 DeMeo ..... A41D 13/11 250/519.1
2004/0023576 A1 * 2/2004 Rock ..... D04B 1/04 442/59
2004/0116022 A1 * 6/2004 Langley ..... A41D 31/02 442/289
2006/0154058 A1 * 7/2006 Neuberg ..... D01F 1/10 428/364
2007/0110999 A1 * 5/2007 Shalaby ..... A61L 17/10 428/364
2008/0058919 A1 * 3/2008 Kramer-Brown ..... A61L 31/08 623/1.34
2009/0000007 A1 * 1/2009 DeMeo ..... A41D 13/1209 2/83
2009/0114857 A1 5/2009 DeMeo et al.
2010/0210161 A1 * 8/2010 Jensen ..... D06M 11/53 442/132
2011/0142898 A1 * 6/2011 Fan ..... A01N 25/34 424/404
2011/0210274 A1 * 9/2011 Kempe ..... A41D 1/22 250/516.1
2013/0206037 A1 * 8/2013 Hamilton ..... C08L 23/12 106/162.9
2014/0021377 A1 * 1/2014 Khandkar ..... B32B 33/00 250/515.1
2014/0117288 A1 * 5/2014 Rebar ..... G21F 1/106 252/478
2014/0158918 A1 * 6/2014 Petroski ..... G21F 1/125 250/515.1
2015/0004131 A1 * 1/2015 Milstein ..... G21F 3/025 424/85.2
2016/0372528 A1 * 12/2016 Kamura ..... H01L 51/0096

FOREIGN PATENT DOCUMENTS

| | | | |
|---|---|---|---|
| CN | 202039178 | U | 11/2011 |
| EP | 2253748 | A1 | 11/2010 |
| EP | 2336401 | A1 | 6/2011 |
| GB | 2196343 | | 4/1988 |
| JP | H11337681 | A | 12/1999 |
| WO | 03083189 | A1 | 10/2003 |
| WO | 2013023167 | A1 | 2/2013 |
| WO | 2014017690 | A1 | 1/2014 |

OTHER PUBLICATIONS

CN 202018834 U. Translation of abstract. 2011.*
Patent Cooperation Treaty written opion of the international searching authority. dated Jun. 30, 2014.*
Composite. (2011). In the Editors of the American Heritage Dictionaries (Ed.), The American Heritage dictionary of the English language. Boston, MA: Houghton Mifflin. Retrieved from http://search.credoreference.com/content/entry/hmdictenglang/composite/0.*
International Search Report dated Jun. 30, 2014, in connection with PCT/SE2014/050412, filed Apr. 4, 2014.
Lamb, George E. R. et al, Influences of Fiber Geometry on the Performance of Nonwoven Air Filters, 1979 Textile Research Institute; 0040-5175/79/0200-0079.

* cited by examiner

| Number of layers | Penetrated dose (uGy) | Air permeability (mm/s) |
|---|---|---|
| 0 | 976 | - |
| 1 | 591 | 1528 |
| 2 | 379 | 1000 |
| 3 | 262 | 750 |
| 4 | 170 | - |
| 5 | 119 | - |
| 6 | 86 | - |

Fig. 3a

| Number of layers | Penetrated dose (uGy) | Air permeability (mm/s) |
|---|---|---|
| 0 | 976 | - |
| 1 | 756 | 454 |
| 2 | 594 | - |
| 3 | 477 | - |
| 4 | 386 | - |
| 5 | 312 | - |
| 6 | 258 | - |

Fig. 3b

RADIATION PROTECTIVE MATERIAL

FIELD OF THE INVENTION

This invention pertains in general to the field of a radiation protective material comprising a fibrous material with filaments including a radiopaque substance. More particularly, the invention relates to a fibrous composite material wherein the filaments are structured into a regular pattern to form the radiation protective material. The radiation protective material may be used for medical applications, such as in a garment for medical applications.

BACKGROUND OF THE INVENTION

In a typical radiological imaging situation, medical staff may be exposed to secondary X-rays with photon energies ranging from 30 to 140 keV. Regular exposure to such radiation involves risk for biological damage caused by radiation energy absorption in the human body.

Radiation protective garments are commonly used to shield healthcare workers, as well as their patients, from radiation exposure during diagnostic imaging. These types of garments are often designed as aprons with additional accessories depending on the type of protection needed. Commonly used accessories are a collar to protect the thyroid from radiation, sleeves and gloves. The patient may be protected from unintentional exposure to radiation by devices such as a drape, gonad, breast, face and thyroid shields, depending on the circumstances of the intervention.

The radiation protective garments are often lead (Pb) based, such as available from Pulse Medical Inc., FL, USA. Lead based garments are generally heavy and impermeable to air, and therefore uncomfortable for the wearer. In addition, they are environmentally unfriendly, and hence hazardous waste on disposal. There are also ergonomic drawbacks with radiation protective garments of larger sizes, such as an apron, due to its inherent weight (approximately 5-10 kg) that may cause back-pain, which in turn may lead to concentration problems or chronic illness.

Non-lead materials are available on the market that are considered more environmentally friendly, based on elements, alloys or salts of for example, Antimony (Sb), Barium (Ba), Tin (Sn), Bismuth (Bi) Wolfram (Tungsten, W) etc. The non-lead protection devices are significantly lighter as compared to the corresponding lead based device.

However, in common with the lead based products, the effectiveness of the today available non-lead protection devices are subject to relatively rapid ageing, cracking and embrittlement. The radiation protective materials used in todays lead and non-lead containing products are present in the shape of one or several layers of air impermeable films. When folded, the material is exposed to stress which may, over time, cause damage to the material that may reduce radiation protection properties. Those products can hence not be folded and needs to be hung in racks during storage. Furthermore, the products are relatively stiff and uncomfortable and cannot be machine-washed without risking causing material weakness, thus compromising radiation safety. Recommended from the manufacturers is to cloth clean with alcohol or similar, which opens for human errors with the consequence of transmitting bacteria from patient to patient as well as between staff. Lightweight or not, the radiology aprons have a plastic cover that protects from fluid strikethrough but also effectively hinder moist to pass the material thus making the wearer warm and sweaty.

US2009000007 discloses a radiation protective fabric material comprising a polymer and a lightweight radiopaque substance extruded as filaments and formed into a breathable fabric. The extruded filaments are spunbond into a web of non-woven fabric. As such, the structure of the filaments cannot be controlled during the production process, wherein the radiation protection may be impaired due to spaces between the filaments. To improve the radiation protective properties of the web, the fabric may be impregnated using a solution including the radiopaque substance, or placing it into a reaction chamber to further treat the fabric. However, the impregnation of the fabric may reduce the breathability of the fabric and make it brittle, stiff, and uncomfortable. It is quite obvious that the radiation protective fabric material does not have sufficient protective qualities by the filaments only, but have to be further processed that impairing the positive properties it has over lead-based products. Furthermore, an impregnated material is cumbersome to clean and thus maintain, since the radiopaque compound precipitated on the carrying fabric is impaired for each time it is cleaned. Hence, it is not suitable for products intended to be reused multiple times, with cleaning and sterilization in-between.

U.S. Pat. No. 6,281,515 discloses a garment with radiopaque qualities, wherein a fabric is impregnated using a solution with a lightweight radiopaque compound. The fabric may comprise paper that is exposed to impregnation or placed in a reaction chamber, such as described above, wherein reagents in the form of barium chloride and sulfuric acid. In one embodiment, one reagent may be formed within the fabric, such as a metal thread, and exposed to the other reagent to form a barium sulfate reagent. However, all the disclosed embodiments disclose impregnation of the fabric, which has the issues as discussed above. Furthermore, using a metal thread makes the fabric stiff and unsuitable for a garment. Metal is also subject to fatigue, after which the radiopaque qualities of the material is deteriorated and if formed into a garment it may no longer be practical to wear if deformed. In the disclosed example, it is used in a breathable mask, which does not need to be folded. However, it would be unsuitable in larger garments, such as an apron.

Another drawback with the utilization of metal threads close to a surgical procedure is the potential hazard of short circuits when performing CPR (Cardiopulmonary resuscitation) procedures, where ungrounded metals may cause severe damage and health risks due to the high voltage electrical field surrounding the patient and operator.

Hence, an improved radiation protective material would be advantageous and in particular allowing for improved breathability, increased flexibility, cost-effectiveness, age-resistance, and/or foldability would be advantageous.

SUMMARY OF THE INVENTION

Accordingly, embodiments of the present invention preferably seek to mitigate, alleviate or eliminate one or more deficiencies, disadvantages or issues in the art, such as the above identified, singly or in any combination by providing a radiation protective material and/or garment according to the appended patent claims.

According to a first aspect of the invention, a radiation protective material comprises a fibrous material with composite filaments including a radiopaque substance, wherein the filaments are structured in a regular pattern to form the radiation protective material.

The radiopaque substance may comprise one or several different metals, in elemental form, in oxidized form, as an alloy, or in salt form, in combination with an organic polymer.

The organic polymer may comprises at least one of polyvinyl, polyolefin, polyester, polyacetate, copolymers of polyvinyl, polyolefin and/or polyester, polyacetate, polyvinyl chloride, polypropene and/or ethyl vinyl acetate.

The metal, in elemental form, in oxidized form, as an alloy or in salt form, may comprise at least one of:

actinium, antimony, barium, bismuth, bromine, cadmium, cerium, cesium, gold, iodine, indium, iridium, lanthanum, lead, mercury, molybdenum, osmium, platinum, pollonium, rhenium, rhodium, silver, strontium, tantalum, tellurium, thallium, thorium, tin, wolfram, and zirconium.

The amount of the radiopaque substance of the filaments may be more than 25% by weight of the total weight filaments and less than 90% by weight of the filaments and the remaining part of the filament may constitute of an organic matrix including process additives and dye.

The structure of the fibrous material may allow for air to penetrate through the material, whereas the air permeability of a single layer of the radiation protective material is in the range of 20 mm/s to 2000 mm/s, preferably 50 mm/s to 1500 mm/s, more preferably 100 mm/s to 750 mm/s.

The structure of the fibrous material may be a woven or knit regular pattern. At least one of the warp and the weft may comprise the radiopaque substance. In some embodiments, the warp and the weft comprise the radiopaque substance.

According to a second aspect of the invention, a garment for use in radiation protection comprises one or several layers of the radiation protective material. The garment may be for medical applications.

According to a third aspect, a method for washing a garment comprises washing the garment with washing liquid. The garment may be washed in a washing machine, such as a rotating drum washing machine. The garment may be washed together with at least one of water and detergent, optionally both. Also, the garment may be washed after folding the garment. Embodiments comprise repeatedly washing the garment between uses thereof.

Further embodiments of the invention are defined in the dependent claims.

Some embodiments of the invention provide for a comfortable radiation protective material that is lightweight and breathable. The material allows vapor, transport through the material, which significantly improves the comfort to the wearer. Furthermore, it is foldable without compromising the effectiveness of the radiation protection. Also, the material provides for easy-to-perform maintenance of any garment made thereof.

It should be emphasized that the term "comprises/comprising" when used in this specification is taken to specify the presence of stated features, integers, steps or components but does not preclude the presence or addition of one or more other features, integers, steps, components or groups thereof.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which

FIGS. 3*a*-3*b* are tables containing data from examples 1 and 2, respectively.

DESCRIPTION OF EMBODIMENTS

Figure 1:
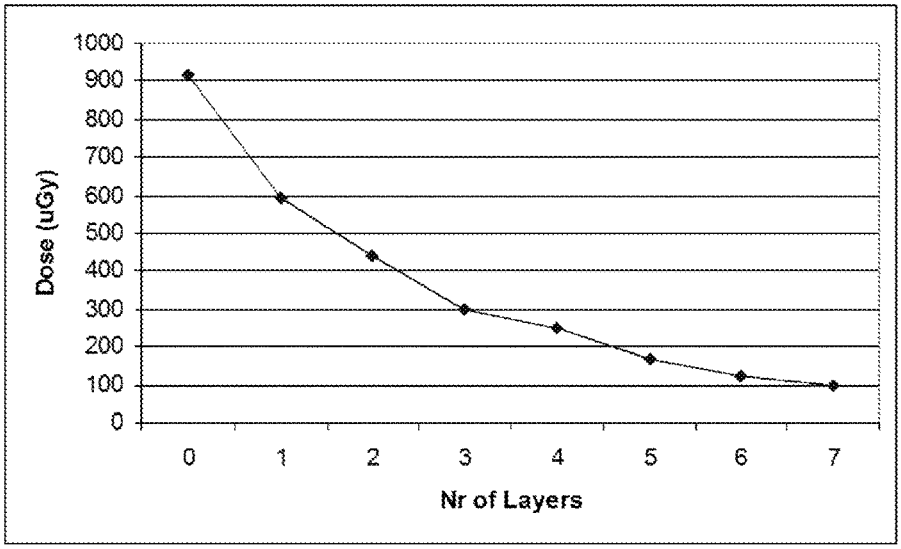
FIG. 1 is a graph showing radiation dose relative protecting using multiple layers of the radiation protection material according to embodiments of the invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

The following description focuses on embodiments of the present invention applicable for medical applications, such as protection for radiation from medical imaging such as X-ray radiography, fluoroscopy, angiography, computed tomography (CT), magnetic resonance imaging (MRI), nuclear medicine tomography (such as SPECT), and position emission tomography (PET). However, it will be appreciated that the invention is not limited to this application but may be applied to many other procedures and areas where exposure to radiation is a risk, such as in nuclear power plants, during disaster relief, and in armed forces.

As will be apparent, the features and attributes of the specific embodiments disclosed herein may be combined in different ways to form additional embodiments, all of which fall within the scope of the present disclosure. For example, a garment made of the radiation protective material according to embodiments of the invention may comprise an apron, pant, jacket, vest, skirt, collar to protect the thyroid from radiation, sleeve, glove, trousers, coat, and cap.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Any process descriptions, elements, or blocks in the flow diagrams described herein and/or depicted in the attached figures should be understood as potentially representing modules, segments, or portions of code which include one or more executable instructions for implementing specific logical functions or steps in the process. Alternate implementations are included within the scope of the embodiments described herein in which elements or functions may be deleted, executed out of order from that shown or discussed, including substantially concurrently or in reverse order, depending on the functionality involved, as would be understood by those skilled in the art.

It should be emphasized that many variations and modifications may be made to the above-described embodiments, the elements of which are to be understood as being among other acceptable examples. All such modifications and variations are intended to be included herein within the scope of this disclosure and protected by the following claims.

Embodiments of the invention comprise a radiation protective material. The radiation protective material comprises a fibrous material with filaments including a radiopaque substance. The filaments are structured in a regular pattern to form the radiation protective material. Such structure may be obtained by weaving or knitting. Hence, the radiation protective material may comprise a woven or knitted material.

The filaments may comprise a composite material including the radiopaque material. As such, it is relatively lightweight, depending on the quantity of radiopaque substance in the composite material. The composite material is lighter than lead based products of the same volume of material.

In some embodiments the composite material comprises an inorganic material, for example an inorganic composition, which includes one or several metals in oxidized form, elemental form, an alloy thereof, or salt form.

In some embodiments, the composite material comprises an organic polymer matrix, such as a thermoplastic polymer. The organic polymer matrix may be selected from any kind of thermoplastic polymer, copolymers etc. In some embodiments, the thermoplastic polymer comprises polyvinyl, polyolefin, polyester, polyacetate and/or copolymers thereof. In some embodiments, the thermoplastic polymer or copolymer comprises polyvinyl chloride, polypropene and/or ethyl vinyl acetate.

In some embodiments, the radiopaque substance may be selected from the group comprising the elements actinium, antimony, barium, bismuth, bromine, cadmium, cerium, cesium, gold, iodine, indium, iridium, lanthanum, lead, mercury, molybdenum, osmium, platinum, pollonium, rhenium, rhodium, silver, strontium, tantalum, tellurium, thallium, thorium, tin, wolfram, and zirconium. Each element may be included in an amount of at least 2% by weight of the inorganic composition.

In some embodiments, element(s) may be included that have complementary energy absorption characteristics in at least a selected portion of the electromagnetic radiation spectrum having energies in the range of 10-200 keV, wherein said element(s) is attenuating electromagnetic radiation having energies of greater than 10 keV to an extent that is equivalent to a layer of metallic lead having a thickness of at least 0.10 mm.

The radiopaque substance may comprise one or several different metals, in elemental form, in oxidized form, as an alloy, or in salt form, as the active radiopaque component. The metal in elemental form, in oxidized form, as an alloy, or in salt form may comprise at least one of: antimony, barium, bismuth, lanthanum, lead, tin, wolfram, and zirconium.

In some embodiments, the composite material comprises two metals, in elemental form, in oxidized form, as an alloy, or in salt form, that are selected within the groups of different embodiments. This provides for optimizing the radiation protective properties in combination with other advantages of the invention, such as low weight, ability to fold, etc., for example depending on the type of garment it will be used for.

In some embodiments, the inorganic material according to any of the embodiments may be combined with multiple polymers. In some embodiments, one polymer may e.g. provide optimized properties to capsule the inorganic material, and another polymer may give the composite material optimized properties for the production technique, such as for weaving. Examples of such combinations include for example the polymer polyvinyl chloride, that provides for capsuling the inorganic material, and Bis(2-ethylhexyl) phthalate, which acts as plasticizer in the polymer matrix. Another example is where a multifilament yarn comprises monofilament fibers of polypropylene, incorporating the radiopaque components, in combination with a monofilament polyester fiber where the polyester fiber provides strength properties, such as enough strength for handling and/or manufacturing the yarn, e.g. through weaving. A combination of two or more of polymers is in some embodiments selected from the list of polymers above.

Figure 2A:
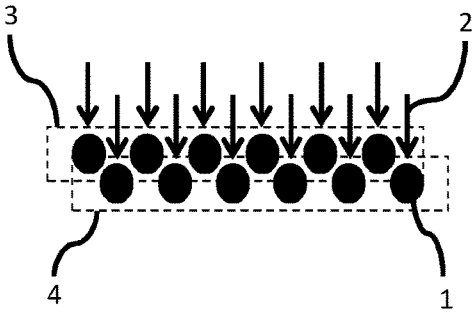
FIGS. 2*a*-2*b* are cross-sectional views of filaments structured according to embodiments of the invention.
Figure 2B:
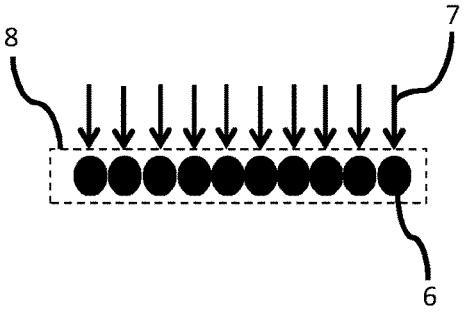

In some embodiments, the composite material comprises an organic polymer matrix, such as listed above, in combination with at least one type of metal, in elemental form, in oxidized form, as an alloy, or in salt form. Thus, the composite material may be made of a mixture of the radiopaque material and the organic polymer matrix. As such, the radiopaque material may be embedded within the organic polymer matrix. Hence, embodiments of invention provide for a substantially even distribution of the radiopaque material within the composite material, whereby the radiopaque properties of the radiation protective material are controlled. This is substantially better than only having the radiopaque substance on the surface of a carrier, such as a carrier made of inorganic material, organic polymer matrix, cotton, paper, etc., wherein the radiopaque material may e.g. be formed by impregnation. Such impregnation techniques have the tendency to agglomerate in fiber crossings, whereby the radiation protective properties are not controlled. The embodiments of the invention do not have this issue, since the radiopaque substance is mixed within the composite material and thus may be substantially evenly distributed within the composite material. Consequently, the radiopaque substance may be substantially evenly distributed over an entire cross section of the filament, such as illustrated in FIGS. 2*a*-2*b*. Hence, the amount of radiopaque substance may be substantially evenly distributed from a center to a surface of the filament, such as illustrated in FIGS. 2*a*-2*b*. In FIGS. 2*a*-2*b*, the filament is illustrated in black to indicate that the distribution of the radiopaque substance is substantially even over the entire cross-section of the filament. Hence, each filament of the composite material according to the invention may be a homogenous filament, such as a homogenous monofilament. The homogenous filament may comprise the radiopaque substance substantially evenly distributed over a cross-section of the filament. This is different to bi-component filaments, wherein the distribution of the radiopaque substance is varies over the cross-section of the filament, a first distribution at the center of the filament for increased radiopacity and a second distribution towards the surface of the filament. The second distribution provides a shell with improved strength but impaired radiopacity. Therefore, the radiopacity over the surface of a radiation protective material made of such filaments will vary over the surface. In order to reduce this effect, the filaments can be packed denser. However, more densely packed filaments reduce the breathability of the material. Embodiments of the invention provide a radiation protective material with a more even radiopacity over the surface as well as increased breathability compared to previously known radiation protective materials.

The amount of the radiopaque substance of the composite material may be in the range of 15-90%, suitably in the range of 25-80%, and preferably more than 25% by weight of the total weight and less than 90% of the total weight of the composite material.

The diameter of the filament may be in the range of 0.1 mm to 2 mm, preferably in the range of 0.5 mm to 1.5 mm, more preferably in the range of 0.6 mm to 1 mm. A filament with a diameter in these ranges provides for a suitable combination of radiation protection, breathability, and ability to fold for practical use as a radiation protective garment. The actual thickness may depend on the actual use of the material.

An example of a composite filament including a radiopaque substance is article number RONH 1030-785/2 from Roney Industri AB, Vellinge, Sweden, consisting of 61% of barium sulphate in a matrix of polyvinyl chloride and additives, having a diameter of 0.7 mm. Another example a composite filament including a radiopaque substance is Barilen 60 from Saxa Syntape GmbH, Luebnitz, Germany which is a multifilament yarn of 60% barium sulphate in a polypropylene matrix, supported by filaments of polyester.

In some embodiments, the radiation protective material comprises 15-30 filaments per centimeter, preferably in the range of 20-25 filaments per centimeter. Each filament has a diameter in the range of 0.3 to 1.2 mm, preferably in the range of 0.5 to 0.9 mm, per centimeter. These ranges provide a radiation protective material that is durable, breathable, and relatively lightweight and yet provides sufficient radiation protective properties. The actual diameter of the filament may be dependent on the intended use for a garment comprising the radiation protective material. In applications where lower radiation protection is required, a radiation protective material comprising a filament with a smaller diameter may be used, such as in the lower part of the range indicated above, for example 0.3 to 0.6 mm. Similarly, in applications where a higher radiation protection is required, a textile material comprising a filament with a larger diameter may be used, such as in the upper part of the range indicated above, for example 0.9 to 1.2 mm. Furthermore, in order to increase the breathability, the number of filaments per centimeter may be reduced, such as to the lower part of the range indicated above, for example 15-20 filaments per centimeter, or vice versa for reduced breathability, for example 25-30 filaments per centimeter. The filament mentioned in the above example may be used in such embodiments.

In some embodiments, the structure of the radiation protective material, i.e. the structure of multiple individual filaments of the fibrous material relative to each other, is woven or knit. In some embodiments, at least one of the warp and the weft comprises filaments including the radiopaque substance, as described above. In some embodiments, filaments forming at least one of the warp and the weft comprise only filaments including the radiopaque substance, as described above, i.e. no other type of filaments. In still other embodiments, both the warp and the weft comprise filaments including the radiopaque substance, as described above, and optionally only such filaments and no other type of filaments. In those embodiments where only the warp or the weft comprise the radiopaque substance, the other filament may comprise a material such as cotton, polyester, nylon or a polyolefin, which does not include any radiopaque substance.

The structure of the radiation protective material comprises the filaments with gaps therebetween. The gaps may be large enough for high air permeability but without compromising the radiation protection. Suitable gaps that provides openness and offers excellent air permeability, and hence providing comfort for the wearer while maintaining a radiation protection, is from about 0.1 mm lead equivalents or more. The openness of one or several materials may be measured by an air permeability test method "Determination of Permeability of Fabrics to Air" (SS-EN ISO 9237:1995) using a pressure difference of 1 mbar. Pending on the weaving technique and selection of fiber diameter, the air permeability may be in the range of 20 mm/s to 2000 mm/s, preferably 50 mm/s to 1500 mm/s, more preferably 100 mm/s to 750 mm/s.

Another way of determining the breathability of the radiation protective material is to measure water vapor resistance. This measurement is very well connected to the appeared comfort of an apparel and is performed by the test method EN 31 092:1993. The number of layers of materials is of significant importance for positive results in evaporation transmission resistance and the appeared comfort for the wearer. The resistance to evaporative heat loss (ret) value of a radiation protection apparel should be below 90, preferably below 70 more preferably below 50 for acceptable appeared comfort.

FIG. 2*a* illustrates an embodiment of the structure of the filaments 1 of the radiation protective material. As is illustrated in FIG. 2*a*, the filaments are arranged such that they protect against radiation 2, such as radiation that is substantially perpendicular to the filaments 1. In this embodiment, a first group 3 of filaments are arranged in a first layer with gaps in-between the filaments of the first group. A second group 4 of filaments are arranged in a second layer with gaps in-between the filaments of the second group 4. Furthermore, there may be gaps in-between neighboring filaments of the first layer and filaments of the second layer. The width of the gaps between neighboring filaments of the first layer are smaller that the width or diameter of the filaments of the second layer, and vice versa. The first group 3 and the second group 4 are arranged such that filaments of the second group 4 cover the gaps between the filaments of the first group, and vice versa. Hence, it is possible to control and optimize the radiation protective properties of the radiation protective material as well as the breathability of the material using the combination of the structure, and the radiopaque properties of the filaments. Furthermore, embodiments of the invention provides for breathability, wherein air is let through in the gaps between the filaments. At the same time, the structure of the filaments allow for blocking radiation, also radiation in the substantially perpendicular direction to the radiation protective material. Each filament of the first group 3 and the second group 4 may be arranged substantially parallel to neighboring filaments in the same group. Filaments of the same group, such as the first group 3, may be arranged parallel to filaments of another group, such as the second group 4. In other embodiments, filaments of one group, such as the first group 3, may be arranged at a non-zero angle relative to the filaments of another group, such as the second group 4.

FIG. 2*b* illustrates an embodiment of the structure of the filaments 6 of the radiation protective material. As is illustrated in FIG. 2*b*, the filaments are arranged such that they protect against radiation 7, such as radiation that is substantially perpendicular to the filaments 6. In this embodiment, the filaments 6 are arranged in a single group 8 with a single layer of filaments. In some embodiments, there are gaps between the filaments 6 to enhance air permeability. In other embodiments, the filaments 6 are structured without, or substantially without, any gaps between the filaments 6 to enhance the radiation protective properties. Hence, it is possible to control and optimize the radiation protective properties of the radiation protective material as well as the breathability of the material using the combination of the structure, and the radiopaque properties of the filaments. Furthermore, embodiments of the invention provides for breathability, wherein air is let through in the gaps between the filaments. At the same time, the structure of the filaments allow for blocking radiation. Radiation substantially perpendicular direction to the radiation protective material may be blocked using several sheets of the radiation protective material. Each filament of the single group 8 may be arranged substantially parallel to neighboring filaments in the single group 8.

In the embodiment of FIGS. 2*a*-2*b*, a single filament forms a yarn. In other embodiments, multi-filament yarns may be used, wherein the yarn is structured in the same way as the filament 2, 6 of FIGS. 2*a*-2*b*.

Examples of regular patterns are fibrous materials made by weaving, knitting and braiding. Weaving techniques that may be used are exemplified by satin and twill, including variations thereof, for example weft double faced broken twill. FIG. 2*b* illustrates an example of a structure obtained when the weft fibers in the structure are organized substantially in parallel to each other, whereas FIG. 2*a* illustrates an example of a structure obtained when the weft fibers in the structure are separated from each other by the warp. Both structures may be present in a woven structure in various proportions pending on the technique used. The weaving technique may hence be selected to obtain desired air permeability and radiation protective properties. The air permeability may also be adjusted by the number of weft filaments contained per centimeter of material produced.

Embodiments of the invention comprise a method for washing a garment made of the radiation protective material according to embodiments of the invention. The garment may be for use in radiation protection. In some embodiments, the garment comprises one or several layers of the radiation protective material as described above. Furthermore, in some embodiments the garment is a garment for medical applications.

According to the method, the garment made of a radiation protective material according to the embodiments of the invention is provided in a step of the method.

According to the method, the garment may be put in a washing machine together with a washing liquid, such as water. I some embodiments, the washing liquid comprises detergent, and optionally also water. In some embodiments, the garment is washed, optionally only together with water or additionally together with detergent, in a washing machine, such as a rotating drum washing machine. In some embodiments the garment is folded before and/or after put in the washing machine, but before washing together with the washing liquid. The method may comprise setting the temperature used in the washing machine between 20 to 95 degrees Celsius. Furthermore, detergent may be added, such as a laundry detergent. An appropriate amount of detergent may be selected according to the instructions of the detergent. The garment may be washed for a suitable time according to the instructions of the washing machine for washing a medical garment. In some embodiments, the garment is hand washed, optionally together with the washing liquid. During washing, the garment, and thus the radiation protective material, will be repeatedly folded. Hence, the method comprises repeatedly folding the garment and washing the folded garment. Since the radiation protective material comprises composite filaments, the washing and/or folding will not compromise the radiation protective function of the garment. This is different from the material in an ordinary radiation protection garment, which is exposed to risk of irreversible stress when folded, whereas the radiation protective material according to embodiments of the invention allows for reversible flexibility and mobility between the filaments. The reversible flexibility and foldability of the material will provide the option for the user to repeatedly wash the garment in a washing machine, fold it and/or store the product folded on a shelf. It is also different from garments made of a material impregnated with a radiopaque substance, for which repeated washing would compromise the impregnation and gradually impair its radiation protective properties. However, the garment according to the invention can be repeatedly washed without compromising its radiation protective properties.

As discussed above, the radiation protective material may be used in a garment for use in radiation protection. The garment may comprise one or several layers of the radiation protective material, such as in order to increase its radiation protective qualities. An increased number of layers will improve the radiation protection and an adequate number of layers will be dependent on each layers radiation protection qualities. To function properly, the embodiment should reduce the radiation penetration by about 90%. However, providing the same level of radiation protection, too many layers of textile radiopaque material may decrease the air permeability, but too few layers may demand a textile to be thick and stiff and hence uncomfortable for the wearer. In some embodiments satisfying these conditions, the garment is made of 1 to 10 layers of the radiation protective material, more preferably the garment is made of 1 to 6 layers of the radiation protective material, even more preferably, the garment is made of 2 to 4 layers of the radiation protective material. The effect on radiation protection from the number of layers of the radiation protective material is illustrated in the table of FIG. 3. A suitable number of layers for a specific material and textile composition is at the point where the level of radiation penetrated through the embodiment has reached 10% of the full exposure.

The radiation protection qualities can be measured in an ordinary X-ray equipment and in the examples below, the X-ray equipment used was a Philips Super8CP (generator) at 100 kV and 10 mAs charge, manufactured by Philips, Eindhoven, Netherlands. The detector used was a RaySafe Xi, manufactured by Unfors AB, Gothenburg, Sweden.

Example 1

A radiation protective material according to embodiments of the invention was made by utilizing commercially available composite filaments including a radiopaque material (RONH 1030-785/2 from Roney Industri AB, Vellinge, Sweden, consisting of 61% of barium sulphate in a matrix of polyvinyl chloride and additives, having a diameter of 0.7 mm). The filaments were structured into a regular pattern by weaving in twill in order to form the radiation protective material and achieve an air permeable textile material having as high radiation protection as possible. The warp used in example 1 was monofilament polypropene (Nm30) with no radiopaque substance added. The twill was constructed with 20 wefts per cm textile material and the surface weight per layer was in this example 1.59 kg/m2.

In the table of FIG. 3*a*, it can be seen that the first layer of radiation protective material significantly decreases the penetrated radiation. Additional layers reduced at a lower degree but were necessary to reach an adequate level of protection. The air permeability acted similarly, where several layers reduced the air permeability. Therefore, the number of layers should be as low as possibly without compromising radiation safety. In this example, 6 layers of the radiation protection material obtained 10% of the full exposure. Using the test method EN 31 092:1993 mentioned above, the water vapor resistance (ret) was measured to 25 on one single layer of the radiation protective material and measured to 47 for two layers of the radiation protective material.

It should be understood that the example illustrates only the air permeability in relation to radiation protection. Another composition of the inorganic compounds would possibly provide higher radiation protection, whereby less layers of textile radiation protection material would be needed. Furthermore, in a product, such as a garment, comprising the radiation protective material, the outer and inner surface of the product may comprise a non-radiation protective surface material that may also somewhat affect the air permeability and water vapor resistance. The measurements demonstrated in this example are only for the radiation protection materials.

Example 2

A radiation protective material according to embodiments of the invention was made by utilizing a commercially available composite filaments including a radiopaque material (Barilen 60 from Saxa Syntape GmbH, Luebnitz, Germany which is a multifilament yarn of 60% barium sulphate in a polypropylene matrix, supported by filaments of polyester. There were 30 filaments at a fiber dimension of 2800-3200 m/kg where the single monofilament barium sulphate containing polypropene fiber had a diameter of about 0.06 mm). The filaments were structured into a regular pattern by weaving in twill in order to form the radiation protective material and achieve an air permeable textile material having as high radiation protection as possible. The warp used in example 2 was cotton (Nm 32/2) with no radiopaque substance added. The twill was constructed with 20 wefts per cm textile material and the surface weight per layer was in this example 0.92 kg/m2.

The table of FIG. 3*b* shows the radiation protection properties and air permeability of the material in various number of layers. It is clearly seen that the radiation protection was less efficient as compared to Example 1 due to its lower surface weight. The multifilament composition with less coarse fibers also reduced the air permeability significantly. It is hence more preferred to have a monofilament of a diameter in the range of 0.5 mm to 1 mm in terms of optimizing air permeability. However, depending on the radiation dosage, a lower surface weight may be desirable.

Additional Embodiments

In another embodiment of a method, which also may be provided separate from the other embodiments mentioned herein, a radiation protective air impermeable sheet, sometimes referred to as casted sheet, is reprocessed into filaments. As such a commercially available material that does not have the desired properties, e.g. breathability, may be used for producing the radiation protective material according to embodiments of the invention. The method comprises shredding the radiation protective air impermeable sheet. Then, the shredded radiation protective material is extruded into filaments in part together with virgin polymers and virgin radiation protective material, or in total without adding any virgin material. The filaments are then processed into a fabric, such as has been discussed above using a weaving or knitting technique. In an example of this embodiment, the results showed that the absorption of X-ray through a woven fabric that comprised a filament provided using this method performed surprisingly well, very close to the performance of the commercial material.

This method is useful for providing a radiation protective material, wherein the weft comprises a filament made from a recycled radiation protective garment. In such embodiments, the warp may comprise a non-radiation protective material, such as a polymer or cotton warp. The recycled radiation protective material may be the radiation protective air impermeable sheet, or any of the radiation protective filaments mentioned above. Recycled radiation protective filaments may be shredded in the same way as has been described above with regard to the sheet. Any warp containing non-radiation protective material is removed before such shredding.

Example 3

A radiation protective material from Kemmetech Ltd (Unit 4 Arnold Business Park, Branbridges Rd, East Peckham, Kent, TN12 5LG, UK) was purchased, with reference code FSLF0125/1200/U/NT. The material is specified as a Lead free vinyl sheet. The sheet was shredded into fragments using a pair of scissors and then fed into an extruder at a temperature of approximately 170 degrees Celsius. The fiber was led through a water bath with very little tension and then winded onto a roll. The fiber diameter was measured to 0.76 mm. The fiber was then woven to a twill fabric using equipment from Dornier. The final fabric had 22 fibers of the radiation protective material per centimeter. The radiation absorption was measured according to the above example using the Philips Super8CP generator. In order to absorb 90% of the irradiation, it was needed 3.48 kg/m2 of the Lead free vinyl sheet from Kemmetech Ltd whereas it was needed 3.61 kg/m2 of the fabric processed as described above. The decrease in performance is partially related to that an inactive warp yarn is needed in the fabric as well as that there is porosity in the fabric that may allow some radiation to pass. However, the increase in weight is relatively small in view of other benefits that are obtained such as breathability and durability for folding.

Additional Examples

Various compositions of fabrics were provided using the filament made using the method including shredding a commercially available radiation protective material. The compositions were tested and evaluated in absorption of radiation. Table 1 shows some results where all samples are fabrics manufactured as specified above and the filaments comprised to 60% wt of a metal, in its salt form or as oxide. The matrix was Ethyl Vinyl Acetate (EVA) and the efficiency was determined to be the surface weight needed to absorb 90% of the exposed radiation (100 kV and 10 mAs). Two samples, Sample A and Sample B, were measured, and the results are shown in Table 1. The measurements show that sufficient absorption is obtained using Wolfram (Tungsten) oxide, Barium sulphate, as well as Tin oxide as the metal, in elemental form, in oxidized form, as an alloy, or in salt form.

TABLE 1

| Metal | Sample A | Sample B |
|---|---|---|
| Wolfram(VI) oxide ($WO_3$) | 0% | 20% |
| Barium sulphate ($BaSO_4$) | 50% | 40% |
| Tin(II) oxide (SnO) | 50% | 40% |
| Surface weight at 90% absorbance (g/m2) | 6.05 | 5.80 |

The present invention has been described above with reference to specific embodiments. However, other embodiments than the above described are equally possible within the scope of the invention. Different method steps than those described above may be provided within the scope of the invention. The different features and steps of the invention may be combined in other combinations than those described. The scope of the invention is only limited by the appended patent claims.

The invention claimed is:

1. A radiation protective material, comprising:

at least one layer of fibrous material with composite filaments, wherein the filaments are structured in a regular pattern to form the radiation protective material, wherein the filaments comprises a radiopaque composite material including a radiopaque substance, wherein the radiopaque substance is mixed within the composite material and substantially evenly distributed within the composite material, wherein the radiopaque substance is substantially evenly distributed over the entire cross section of the filament, from a center to a surface of the filament, and said filaments are made of a mixture of the radiopaque substance and an organic polymer matrix, such that radiopaque substance is embedded within the organic polymer matrix, wherein the radiopaque substance comprises at least one metal in oxidized form, elemental form, as an alloy, or in salt form in combination with the organic polymer matrix, and wherein the organic polymer matrix comprises at least one of polyvinyl, polyolefin, and polyacetate;

wherein the fibrous material is a woven regular pattern having 15-30 filaments per centimeter;

wherein an amount of the radiopaque substance of the filaments is more than 25% by weight less than 90% by weight of the total weight of the filaments;

wherein each filament forms a single filament yarn;

wherein the fibrous material comprises a first group of filaments and a second group of filaments, wherein the filaments of the first group are arranged in parallel in a first plane with gaps in-between the filaments of the first group, and the filaments of the second group are arranged in parallel in a second plane with gaps in-between the filaments of the second group, and wherein gaps are provided to permit airflow between a filament of the first group and neighboring filaments of the second group, and wherein each filament of the second group has a diameter sized to partially overlap two filaments of the first group along the length of the filaments and to cover the gap between the two filaments of the first group, the filaments have a diameter in the range of 0.5 mm to 1.5 mm; and wherein said combination of woven regular pattern, filaments per centimeter, amount of radiopaque substance and filament diameter together provide said at least one layer with a radiopacity that permits penetration of not more than about 60% of X-ray radiation when exposed at 100 kV and 10 mAs charge in combination with a water-vapor resistance of up to 25 Ret.

2. The material according to claim 1, wherein:

the at least one metal comprises at least one of actinium, antimony, barium, bismuth, bromine, cadmium, cerium, cesium, gold, iodine, indium, iridium, lanthanum, lead, mercury, molybdenum, osmium, platinum, pollonium, rhenium, rhodium, silver, strontium, tantalum, tellurium, thallium, thorium, tin, wolfram, and zirconium.

3. The material according to claim 1, wherein the fibrous material comprises a structure that allows for air to penetrate through the material, wherein the air permeability of a single layer of the radiation protective material is in the range of about 20 mm/s to 2000 mm/s, when measured using a pressured difference of 1 mbar.

4. The material according to claim 3, wherein the air permeability of a single layer of the radiation protective material is in the range of about 50 mm/s to 1500 mm/s, when measured using a pressure difference of 1 mbar.

5. The material according to claim 4, wherein the air permeability of a single layer of the radiation protective material is in the range of 100 mm/s to 750 mm/s, when measured using a pressure difference of 1 mbar.

6. The material according to claim 1, wherein at least one of a warp and a weft of the woven fibrous material comprises the radiopaque substance.

7. The material according to claim 6, wherein the weft comprises a filament made from recycled radiation protective garment, and the warp comprises non-radiation protective material.

8. The material according to claim 6, wherein the warp and the weft comprise the radiopaque substance.

9. A garment for use in radiation protection, wherein the garment comprises one or several layers of the radiation protective material of claim 1.

10. The garment according to claim 9, wherein the garment is a garment for medical applications.

11. The garment according to claim 10, wherein the garment is at least one of an apron, pant, jacket, vest, skirt, collar to protect the thyroid from radiation, sleeve, glove, trousers, coat, or cap.

12. The garment according to claim 10, wherein the garment comprises 1 to 10 layers of the radiation protective material.

13. The material according to claim 1, wherein a remaining part of the filament comprises an organic matrix including process additives and dye.

14. The material according to claim 1, wherein the filaments have a diameter in the range of 0.6 mm to 1 mm.

15. The material according to claim 1, wherein the material is an ionizing radiation protective material.

16. The material according to claim 1, wherein:

the at least one metal comprises at least one of actinium, antimony, barium, bismuth, bromine, cadmium, cerium, cesium, gold, iodine, indium, iridium, lanthanum, lead, mercury, molybdenum, osmium, platinum, pollonium, rhenium, rhodium, silver, strontium, tantalum, tellurium, thallium, thorium, tin, wolfram, and zirconium.

17. The material according to claim 1, wherein said composite filaments are made of a mixture of the radiopaque substance and an organic polymer matrix, such that radiopaque substance is embedded within the organic polymer matrix.

18. The material according to claim 1, wherein said material has an electromagnetic radiation attenuation that is equivalent to a layer of metallic lead having a thickness of at least 0.10 mm.

19. The material according to claim 1, wherein the at least one metal comprises antimony.

20. The material according to claim 1, wherein the at least one metal comprises lead.

21. The material according to claim 1, wherein the at least one metal comprises wolfram.

22. A garment formed of plural said layers of radiation protective material according to claim 1, wherein said garment has a water-vapor resistance below 90 Ret and a radiopacity that permits penetration of not more than about 10% of X-ray radiation when exposed at 100 kV and 10 mAs charge.

23. The radiation protective material according to claim 1, further comprising at least six said layers, wherein said material has a radiopacity that permits penetration of not more than about 10% of X-ray radiation when exposed at 100 kV and 10 mAs charge.

24. A radiation protective material, comprising:

at least one layer of fibrous material, said at least one layer comprising composite filaments with 15-30 filaments per centimeter and a filament diameter in the range of 0.5 mm to 1.5 mm, wherein the filaments are structured in a regular pattern to form the radiation protective material, wherein the fibrous material comprises a first group of filaments and a second group of filaments, wherein the filaments of the first group are arranged in parallel in a first plane with gaps in-between the filaments of the first group, and the filaments of the second group are arranged in parallel in a second plane with gaps in-between the filaments of the second group, and wherein gaps are provided to permit airflow between a filament of the first group and neighboring filaments of the second group, and wherein each filament of the second group has a diameter sized to partially overlap two filaments of the first group along the length of the filaments and to cover the gap between the two filaments of the first group, wherein the filaments comprise a radiopaque composite material including a radiopaque substance, wherein the radiopaque substance is substantially evenly distributed over the entire cross section of the filament, from a center to a surface of the filament, and said filaments are made of a mixture of the radiopaque substance and an organic polymer matrix, such that radiopaque substance is embedded within the organic polymer matrix, wherein the radiopaque substance comprises at least one metal in oxidized form, elemental form, as an alloy, or in salt form in combination with the organic polymer matrix;

wherein said fibrous material, said filaments per centimeter, said filament diameter, said filament structure and said radiopaque composite material in combination provides said at least one layer with a radiopacity that permits penetration of not more than about 60% of X-ray radiation when exposed at 100 kV and 10 mAs charge and water-vapor resistance of up to 25 Ret.

25. The material according to claim 24, wherein the at least one metal comprises antimony.

26. The material according to claim 24, wherein the at least one metal comprises lead.

27. The material according to claim 24, wherein the at least one metal comprises wolfram.

28. The material according to claim 24, wherein the fibrous material comprises a structure that allows for air to penetrate through the material, wherein the air permeability of a single layer of the radiation protective material is in the range of about 20 mm/s to 2000 mm/s, when measured using a pressure difference of 1 mbar.

29. The material according to claim 28, wherein the air permeability of a single layer of the radiation protective material is in the range of about 50 mm/s to 1500 mm/s, when measured using a pressure difference of 1 mbar.

30. The material according to claim 24, wherein the fibrous material is a woven regular pattern.

31. The material according to claim 30, wherein the air permeability of a single layer of the radiation protective material is in the range of 100 mm/s to 750 mm/s, when measured using a pressure difference of 1 mbar.

32. The material according to claim 24, wherein an amount of the radiopaque substance of the filaments is more than 25% by weight less than 90% by weight of the total weight of the filaments.

33. The material according to claim 24, wherein the filaments have a diameter in the range of 0.6 mm to 1 mm.

34. A garment for use in radiation protection, wherein the garment comprises one or several layers of the radiation protective material of claim 24.

35. The garment according to claim 34, wherein the garment comprises 1 to 10 layers of the radiation protective material.

36. The material according to claim 24, wherein the at least one metal comprises barium sulfate.

37. A radiation protective material, comprising at least one layer of fibrous material with composite filaments structured in a regular pattern to form the at least one layer of radiation protective material, wherein:

the filaments are woven in a regular pattern with structure that allows for air to penetrate through the material with an air permeability in a single layer in the range of about 20 mm/s to 2000 mm/s, when measured using a pressure difference of 1 mbar;

the filaments are made of a mixture of at least one radiopaque metal in oxidized form, elemental form, as an alloy, or in salt form embedded within an organic polymer matrix, the at least one radiopaque metal comprises one of barium sulfate, antimony, lead or wolfram and is substantially evenly distributed over the entire cross section of the filaments, from a center to a surface of the filaments;

the organic polymer matrix comprises at least one of copolymers of polyvinyl, polyolefin and polyester;

an amount of radiopaque metal of the filaments is more than 25% by weight less than 90% by weight of the total weight of the filaments; and the filaments have a diameter in the range of 0.5 mm to 1.5 mm, and a distribution comprising 15-30 of said composite filaments per centimeter per layer of said material;

wherein the fibrous material comprises a first group of filaments and a second group of filaments, wherein the filaments of the first group are arranged in parallel in a first plane with gaps in-between the filaments of the first group, and the filaments of the second group are arranged in parallel in a second plane with gaps in-between the filaments of the second group, and wherein gaps are provided to permit airflow between a filament of the first group and neighboring filaments of the second group, and wherein each filament of the second group has a diameter sized to partially overlap two filaments of the first group along the length of the filaments and to cover the gap between the two filaments of the first group, and wherein said woven regular pattern, said mixture of at least one radiopaque material within the organic polymer matrix, said at least one radiopaque metal, and said filament diameter and distribution in combination provide said at least one layer with a radiopacity that permits penetration of not more than about 60% of X-ray radiation when exposed at 100 kV and 10 mAs charge.

38. The radiation protective material according to claim 37, wherein said at least one layer has a water-vapor resistance of up to 25 Ret.

39. The radiation protective material according to claim 37, further comprising at least six said layers, wherein said material has a radiopacity that permits penetration of not more than about 10% of X-ray radiation when exposed at 100 kV and 10 mAs charge.

* * * * *